United States Patent [19]

Burris

[11] Patent Number: 4,703,576

[45] Date of Patent: Nov. 3, 1987

[54] SCOPE MOUNT FOR RUGER RIFLES

[75] Inventor: Donald J. Burris, Greeley, Colo.

[73] Assignee: Burris Company, Inc., Greeley, Colo.

[21] Appl. No.: 899,676

[22] Filed: Aug. 25, 1986

[51] Int. Cl.[4] ..... F41G 1/38

[52] U.S. Cl. ..... 42/101; 33/247; 33/250

[58] Field of Search ..... 42/101, 102, 103, 106; 33/245, 246, 247, 248, 249, 250

[56] References Cited

U.S. PATENT DOCUMENTS

| | | | |
|---|---|---|---|
| 1,837,290 | 12/1931 | Redfield | 33/247 |
| 2,486,002 | 10/1949 | Buehler | 33/247 |
| 2,717,447 | 9/1955 | Leupold | 33/245 |

*Primary Examiner*—Charles T. Jordan
*Assistant Examiner*—Michael J. Carone
*Attorney, Agent, or Firm*—Edwin L. Spangler, Jr.

[57] ABSTRACT

This invention relates to an improved laterally-adjustable ring-type riflescope mount for attachment to rifle barrel receivers of the type having a one part of a dovetail connection atop thereof defined by a planar top surface alongside of which lie a spaced parallel pair of upwardly-divergent longitudinally extending groove walls, said mount being characterized by a base having a planar bottom wall adapted to rest upon the top surface of the receiver in supported relation, a pair of sidewalls, a pair of upwardly and inwardly-convergent internally-threaded sockets in the sidewalls each having the axis thereof perpendicular to their respective upwardly-divergent dovetail groove walls, and a pair of large-headed screws screwed into the sockets with the heads thereof overlapping the upwardly-divergent groove wall lying in opposed relation thereto, these screws cooperating with one another when screwed in tight against the divergent dovetail groove walls to hold the base down snugly atop the receiver, and these same screws when thus tightened providing for lateral adjustment of the base relative to the receiver as one screw is loosened and its companion tightened a corresponding amount.

1 Claim, 3 Drawing Figures

SCOPE MOUNT FOR RUGER RIFLES

BACKGROUND OF THE INVENTION

In the mounting of a riflescope upon the barrel of a rifle it is of utmost importance that provision be made for "zeroing in" the scope which is the process by which the line-of-sight established by the reticle in the scope that defines the point of impact of the bullet be made coincident with the axis of the bore at some preselected range, say 150 yards. While most, if not all, riflescopes provide limited adjustments to correct for windage and elevation, these should not have to be used, and in most cases are insufficient, to make gross adjustments to zero in the scope initially. Instead, lateral and vertical adjustments in the mounting hardware by means of which the scope is attached to the rifle barrel should provide the means for making such corrections and, once made, they should remain fixed. Certain rifle manufacturers, Ruger for one, make their so-called "receiver" integral with the barrel and since the scope mounting rings attach to this receiver, if it is significantly misaligned in any way with respect to the bore axis, there is no way of correcting the misaligned condition except for the rings themselves. Up until now at least, the scope mounting rings supplied by the rifle manufacturer include no such adjustment feature and, in addition, are considerably more complicated and expensive to manufacture than they need to be.

FIELD OF THE INVENTION

The present invention, therefore, relates to a novel and improved laterally-adjustable scope-mounting ring specifically adapted for use upon Ruger rifles of the type having an integrally-formed receiver. The invention also encompasses a significantly simplified construction of the rings.

DESCRIPTION OF THE RELATED ART

The most pertinent prior art comprises the scope-mounting rings sold by the rifle manufacturer, Ruger, which consists of a two-piece dovetail clamp built into the base of the ring. More specifically, the base of the ring is provided on one side with a downwardly-projecting fixed abutment positioned and adapted to engage the undercut groove on one side of the dovetailed receiver. Above this fixed abutment is a transverse bore that receives a cap screw which threads into a movable abutment shaped like the fixed one and similarly positioned. With the fixed abutment seated in the dovetail groove on one side of the receiver, the cap screw is tightened to draw the movable one in snug against the groove in the other side thus completing the connection. The result is, of course, that the ring is fixed with respect to the receiver and the rifle barrel and, therefore cannot be moved from side-to-side to correct for any misalignment resulting from the way the grooves were cut relative to the rifle bore axis.

SUMMARY OF THE INVENTION

The present invention relates to an improvement in the aforementioned scope ring mount whereby instead of using a dovetail clamp having fixed and movable abutments with the latter being movable by means of a transversely-extending cap screw, two independently movable broad-headed screws are threaded into a pair of upwardly and inwardly convergent threaded sockets contained in the base of the ring, each of which has its axis perpendicular to the plane defined by the upwardly and outwardly inclined face of the dovetail groove in the receiver. These sockets lie immediately adjacent the upper outside edges of the dovetail such that the heads of the screws will overlap the side-opening grooves forming same while engaging and locking under the inclined surfaces of the latter. With the base of the ring resting atop the receiver to fix the relative vertical position of the ring with respect to the rifle barrel, limited lateral adjustment is possible by merely loosening one screw and tightening the other.

DESCRIPTION OF THE PREFERRED EMBODIMENTS

Figure 1:
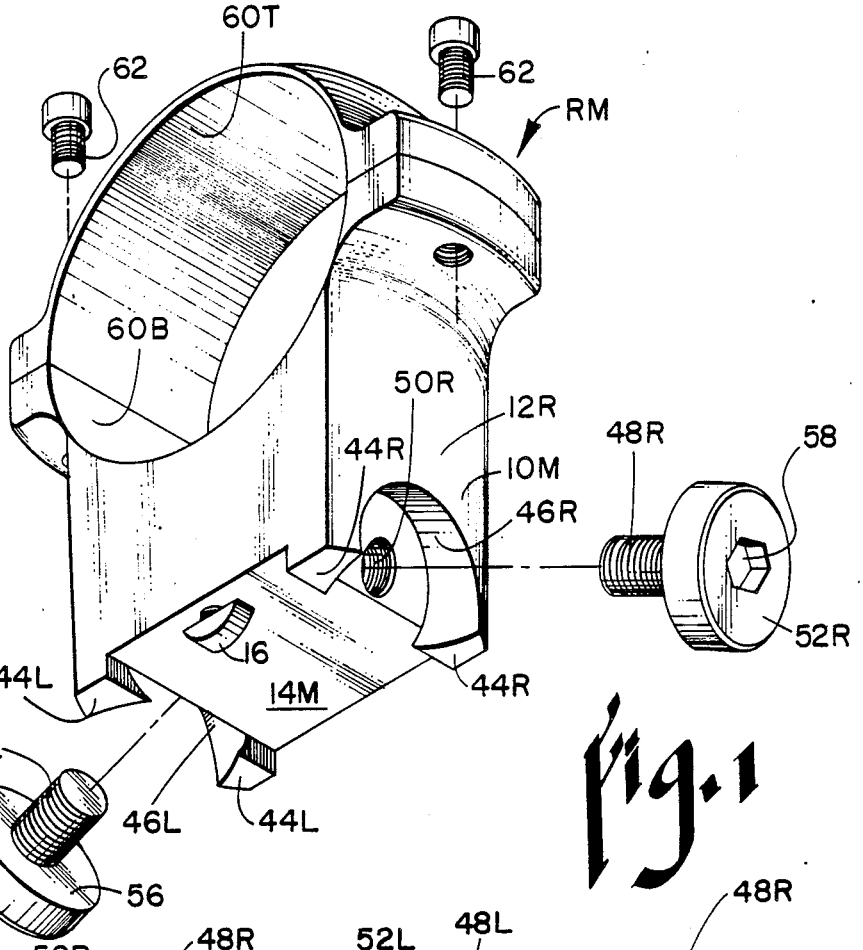
FIG. 1 is an exploded perspective view showing the laterally adjustable scope-mounting ring.

Referring first of all to the figure labeled "PRIOR ART" wherein one of a pair of the conventional Ruger riflescope mounting ring has been illustrated, it will be seen to have a base 10 provided with spaced-apart parallel right and left sidewalls, 12R and 12L, respectively. On the bottom of the base is a flat wall 14 beneath which projects a small more or less semicylindrically-shaped ear 16 adapted to be loosely received in the concave groove 18 that extends fore-and-aft atop the receiver 20 between the spaced parallel and coplanar rails 22 atop which the base 10 rides. On the sides of the receiver 20 adjacent the rails 22 will be found a spaced parallel pair of side-opening V-shaped grooves 24R and 24L the upwardly and outwardly inclined surfaces 26R and 26L of which cooperate with one another and with the top of the base where the rails and concave groove 18 are located to define a so-called "dovetail" connection of more or less standard design. In the particular form shown, a fixed abutment 28 formed integral with the base 10 on the left side thereof is shaped to engage and lock beneath upwardly and outwardly inclined dovetail surface 26L. A transverse bore 28 extends across the base paralleling the underside 14 thereof. A socket 30 in its left end defines an annular shoulder 32 against which the opposed surface 34 underneath the head 36 of capscrew 38 rides as it turns and retracts or extends the movable abutment 40 threadedly attached to the other end thereof. Movable abutment 40, like the fixed one 28 on the left side, has a complementary upwardly and outwardly inclined surface 42R which mates with the corresponding surface 26R of the dovetail to complete the connection between the ring R and the receiver 20. It is significant to note, however, that the lateral position of the ring R relative to the receiver 20 is fixed by reason of the fixed abutment 28 being at all times seated against the surface 26L of the dovetail as shown. Movable abutment 40 merely comprises the movable jaw of a clamp or vise that provides for no adjustment whatsoever.

Figure 2:
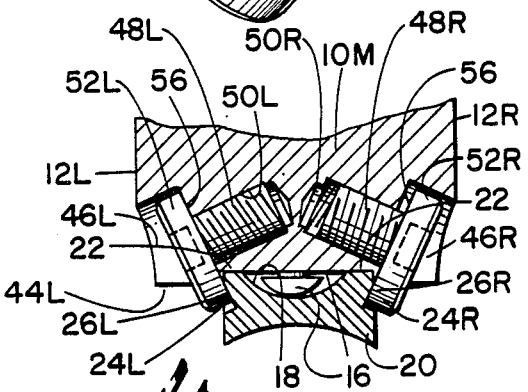
FIG. 2 is a fragmentary vertical section showing the mounting screws engaging the inclined surfaces of the dovetail on the rifle barrel receiver so as to shift the ring relative thereto to the left.
Figure 3:
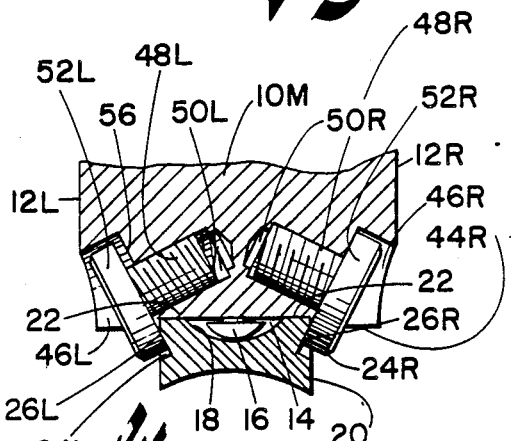
FIG. 3 is a fragmentary vertical section like FIG. 2 except that the mounting screws are shown readjusted to shift the ring to the right; and, the remaining figure labeled "PRIOR ART" illustrates the conventional Ruger scope ring mount.
Figure 4:
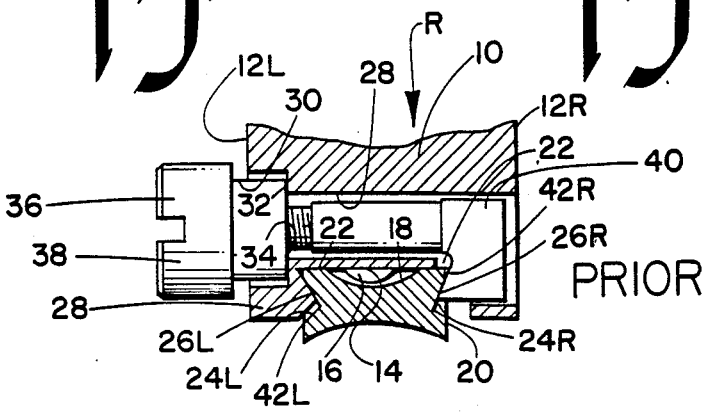
PRIOR ART Fig. 4

Directing the attention next to FIGS. 1, 2 and 3 of the drawings, it will be seen that the modified scope-mounting ring of the present invention which has been designated in a general way be reference characters RM has a modified base 10M which, as was the case with the prior art scope-mounting ring has right and left spaced parallel sidewalls 12R and 12L, a modified bottom wall 14M which has no fixed abutment 28 but rather is reshaped to include short extensions 44L and 44R of recessed screwhead-receiving sockets 46L and 46R that extend somewhat below the plane of the bottom wall 14M. The inwardly-facing opposed surfaces of these extensions are spaced apart a distance greater than the width of the dovetail atop the receiver so as to permit lateral adjustment of the former relative to the latter. They, together with downwardly-projecting ear 16 which is common to both the prior art and improved rings of the present invention, cooperate with one another and with receiver groove 18 and side margins of the dovetail to prevent the rings from rotating but a few degrees about a vertical axis prior to the time the scope (not shown) is in place to maintain the coaxially-aligned relation between the pair required to mount the latter.

The novelty in the instant scope-mounting ring is found in the large-headed screws 48L and 48R together with the inclination and placement of the internally-threaded screw-receiving sockets 50L and 50R in the sides 12L and 12R of the base 10M which receive same. These sockets 50 are upwardly and inwardly inclined along axes perpendicular to the planes of their respective dovetail groove inclined surfaces 26L and 26R. Also, they lie closely adjacent the bottom wall 14M thus placing the screws 48 such that the enlarged heads 52 thereover overlap the aforementioned inclined groove walls or surfaces 26 in the manner shown in FIGS. 2 and 3. The undersurfaces 56 of the screwheads are substantially planar so as to mate with the similarly-shaped opposing surfaces 26 of the dovetail grooves 24 thereby holding the base 10M of the ring RM down tight against the rails 22 atop the receiver 20.

With specific reference to FIGS. 2 and 3, in the former it can be seen that the lefthand screw 48L is substantially completely seated in its socket 50L; whereas, its companion 48R, while abutted tightly against inclined wall 26R of the dovetail groove 24R, is, nevertheless left part way out of its socket 50R with the net result that the entire ring RM is shifted slightly to the left of center. In FIG. 3, on the other hand, the opposite is true and righthand screw 48R is seated in the bottom if its socket 50R while its counterpart on the left side, 48L is not thus offsetting the ring to the right. In both cases, however, the bottom 12M of the base rests snugly atop the rails 22 of the receiver.

Obviously, FIGS. 2 and 3 represent the extremes of the possible adjustment and, ordinarily, some lesser degree of adjustment lying between what is illustrated would be all that is necessary to accommodate a misaligned dovetail on the receiver with respect to the rifle barrel bore. Nevertheless, such an adjustment may be essential if a misaligned condition exists. Mention should also be made of the simplicity of the construction when compared with that of the prior art; yet, with significantly increased versatility and utility.

A conventional socket 58 is provided in the screwheads for purposes of tightening same against the dovetail grooves. Above the base 10M is the conventional split ring subassembly 60B and 60T detachably fastened together around the scope barrel (not shown) using cap screws 62. The latter may, of course, be offset to the front or rear of the base while remaining integral therewith in a manner well known in the art to accommodate short and extra long barreled scopes. In like manner, the height of the base can vary to provide a low mount, an intermediate one or even a high mount designed to accommodate iron sights therebeneath.

What is claimed is:

1. A laterally adjustable ring-type riflescope mount for detachable connection to receivers atop a rifle barrel of the type having upwardly-facing substantially planar supporting surfaces along both sides of which are positioned longitudinally-extending grooves with upwardly divergent planar sidewalls cooperating therewith and with one another to define one part of a dovetail connection, which comprises: a base having sidewalls spaced apart a distance greater than the width of the receiver and a bottom wall, said sidewalls including extensions projecting beneath said bottom wall in spaced relation to the sides of the receiver, and said extensions defining abutments positioned and adapted to contact the sides of the receiver and limit the angular excursion of the base relative thereto about a vertical axis, screw-receiving internally-threaded sockets in the sidewalls adjacent the bottom wall arranged in upwardly-convergent relationship such that the axes thereof are substantially perpendicular to the planes of the corresponding divergent dovetail groove sidewalls, and a pair of large-headed screws threaded into said sockets with portions of the heads thereof projecting beneath the bottom wall in overlapping relation to said dovetail groove sidewalls while cooperating therewith when interengaged to hold the bottom of said base snugly down atop the supporting surface of the receiver, said screws and their respective sockets cooperating with one another to shift the base laterally with respect to the receiver as one is screwed in while the other is screwed out a corresponding distance while remaining thus assembled.

* * * * *